US005159298A

United States Patent [19]

Dydyk

[11] Patent Number: 5,159,298

[45] Date of Patent: Oct. 27, 1992

[54] MICROSTRIP DIRECTIONAL COUPLER WITH SINGLE ELEMENT COMPENSATION

[75] Inventor: Michael Dydyk, Scottsdale, Ariz.

[73] Assignee: Motorola, Inc., Schaumburg, Ill.

[21] Appl. No.: 647,090

[22] Filed: Jan. 29, 1991

[51] Int. Cl.[5] ..... H01D 5/18

[52] U.S. Cl. ..... 333/112; 333/116

[58] Field of Search ..... 333/109, 111, 112, 115, 333/116

[56] References Cited

U.S. PATENT DOCUMENTS

| | | | |
|---|---|---|---|
| 3,593,208 | 7/1971 | Smith | 333/112 |
| 4,216,446 | 8/1980 | Iwer | 333/112 |
| 5,055,809 | 10/1991 | Sagawa et al. | 333/204 |

FOREIGN PATENT DOCUMENTS

| | | | |
|---|---|---|---|
| 0062402 | 5/1981 | Japan | 333/116 |

*Primary Examiner*—Eugene R. LaRoche
*Assistant Examiner*—Michael B. Shingleton
*Attorney, Agent, or Firm*—Jeffrey D. Nehr

[57] ABSTRACT

A microstrip directional coupler which employs closed form solutions for compensating capacitance or inductance and odd mode characteristic impedance necessary to realize high directivity or match in microstrip directional couplers valid for tight and loosely-coupled sections. A microwave monolithic integrated circuit (MMIC) directional coupler with single capacitive or inductive compensation derives from a mathematical analysis using symmetry and reflection and transmission coefficients' equivalency. Closed form solutions for the compensating capacitance or inductance and a new odd mode characteristic impedance are generated. The results are implemented in single antisymmetric inductive and antisymmetric and symmetric capactive compensated versions.

8 Claims, 3 Drawing Sheets

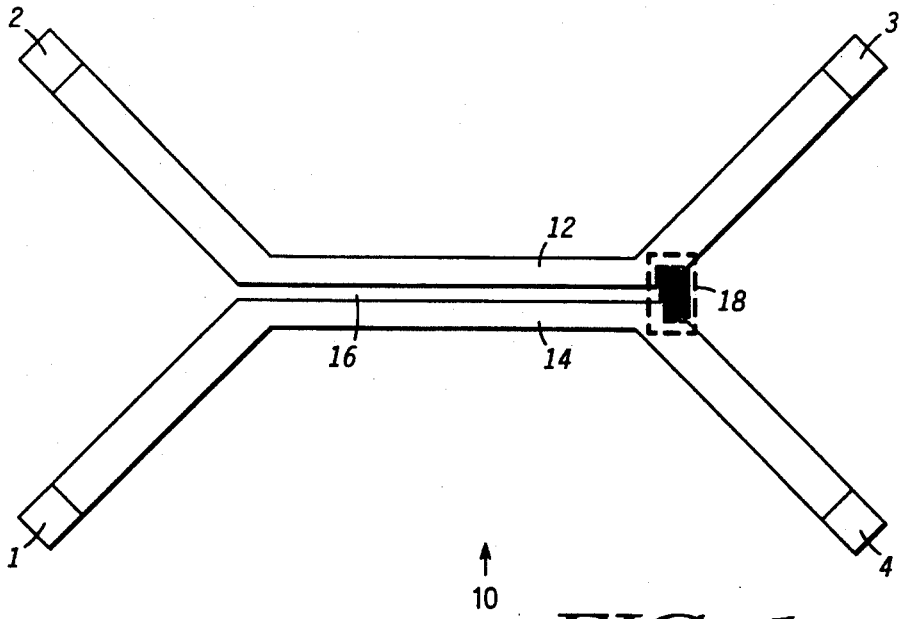
FIG. 1
FIG. 2
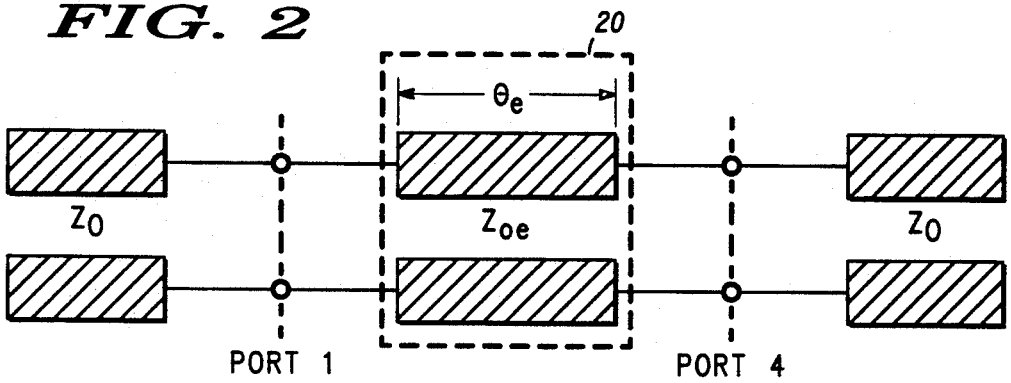
FIG. 3
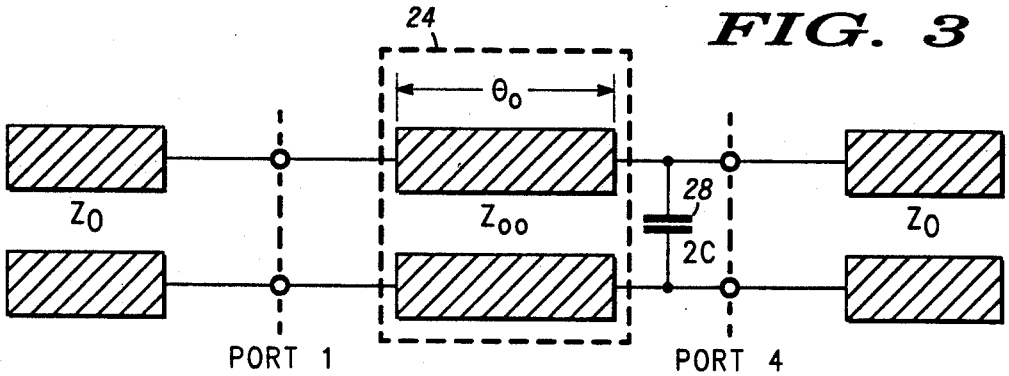

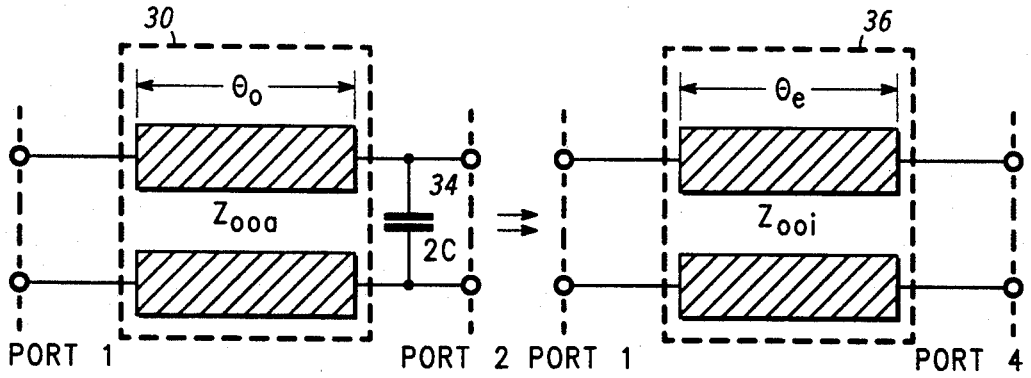
FIG. 4
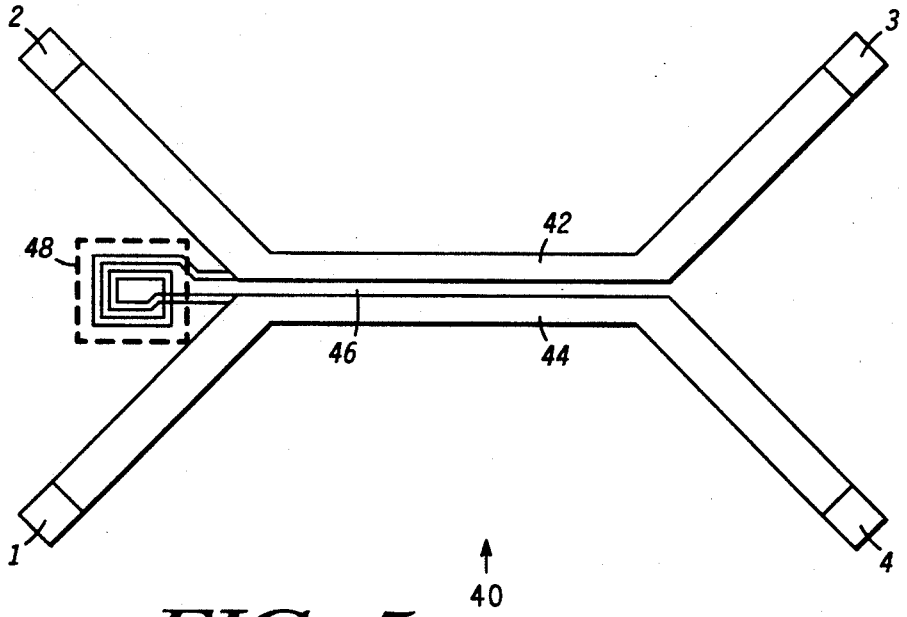
FIG. 5
FIG. 6
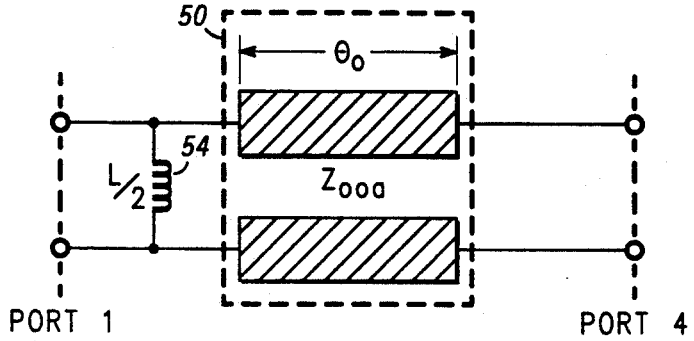

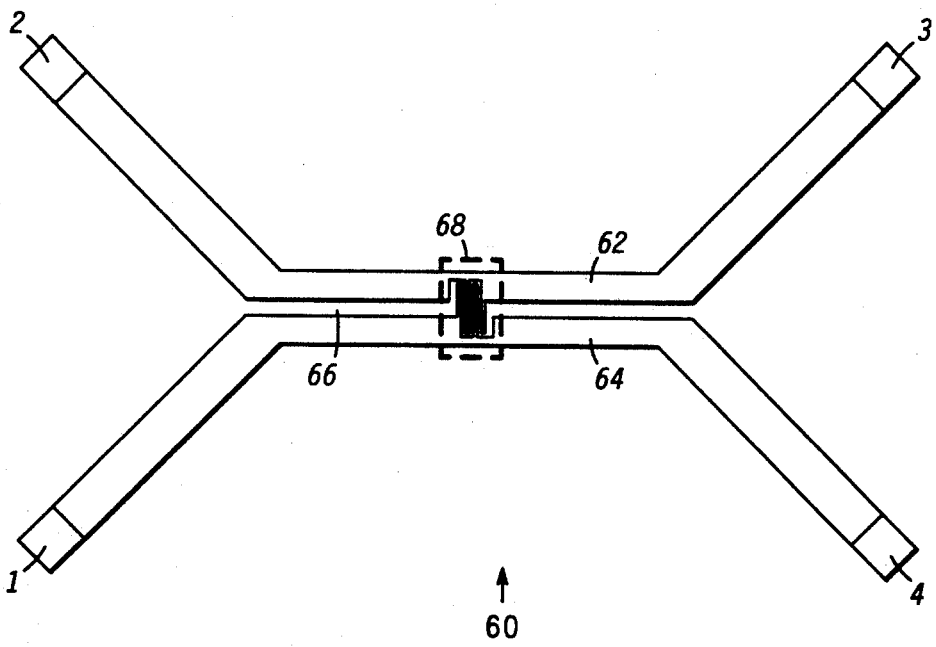
FIG. 7
FIG. 8
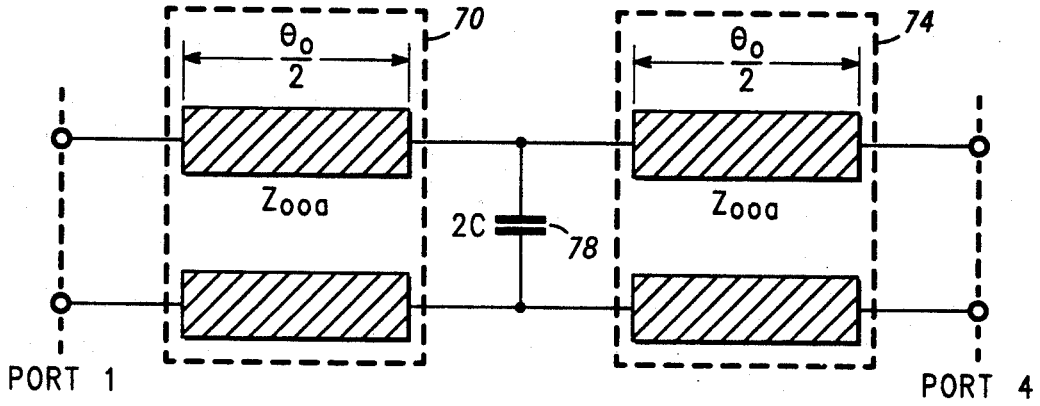

MICROSTRIP DIRECTIONAL COUPLER WITH SINGLE ELEMENT COMPENSATION

BACKGROUND OF THE INVENTION

This invention relates in general to the field of directional couplers, and in particular to microstrip directional couplers using capactive or inductive compensation.

Quadrature directional couplers consisting of parallel-coupled microstrip transmission lines are used extensively in microwave and millimeter-wave integrated hybrid monolithic circuits. In general, quadrature directional couplers can be used in any microwave or millimeter-wave subsystem with applications which include, among others, power sensing, combining, dividing, balanced mixing, amplifying, and antenna feed networks.

Because microstrip transmission lines have an inhomogeneous dielectric consisting of part dielectric and part air, odd and even mode phase velocities in the transmission lines are unequal. This inequality manifests itself in the coupler's poor directivity. It is well known that the directivity performance becomes worse as the coupling is decreased, or as the dielectric permittivity is increased.

There are several traditional methods of improving the directivity of such couplers, including adding an additional layer of dielectric over the conductors for symmetry, serrating the gap between the conductors, adding lumped capacitors at each end of the coupler, or selecting two or more different materials of different thicknesses and permittivities for the multilevel substrate. However, each of these methods is associated with particular disadvantages. For example, adding a slab of dielectric above the conductive path for symmetry adds material and introduces adhesive between the metallization and the substrate. Such a structure, which is not monolithic, may require handcrafting, or at least additional fabrication steps. Serrating the gap between the conductors does not produce a satisfactory or sufficient compensation for all values of the coupling. In addition, as is also the case for adding lumped capacitors at each end of the coupler, there is only a crude design method for determining appropriate compensation relies heavily on empirical means. None of these methods encompass an accurate solution for the compensation necessary to realize an ideal microstrip directional coupler.

For example, while the developed equations for determination of lumped capacitance to add at each end of the coupler are nearly true for tight coupling, the center frequency predicted is lower than desired. This result necessitates foreshortening the coupled section. Furthermore, for loosely coupled sections, the equations are no longer valid. A single capacitive compensation method for directional couplers has been proposed by Herbert W. Iwer in U.S. Pat. No. 4,216,446, but the disclosure does not instruct how to execute the design.

Thus, what is needed is a method which overcomes previous shortcomings and has associated with it a closed form solution for the compensating lumped capacitance and a new odd mode characteristic impedance necessary to realize an ideal microstrip directional coupler. The results need to be accurate for either tight or loosely-coupled sections. The method should result in embodiments for both antisymmetric and symmetric microstrip directional couplers with single inductive or capacitive compensation.

SUMMARY OF THE INVENTION

Accordingly, it is an advantage of the present invention to provide a microstrip directional coupler which employs closed form solutions for the compensating capacitance or inductance and introduces a new odd mode characteristic impedance necessary to realize high directivity or match in microstrip directional couplers. It is also an advantage to provide accurate quadrature microstrip directional couplers valid for tight and loosely-coupled sections.

To achieve these advantages, a microwave monolithic integrated circuit (MMIC) directional coupler with single capacitive or inductive compensation is contemplated which derives from use of reflection or transmission coefficients' equivalency. Closed form solutions for the compensating capacitance or inductance and a new odd mode characteristic impedance are generated. Structures using a single element compensation for a MMIC directional coupler are analyzed by transmission or reflection coefficient equivalency. The results provide accurate quadrature microstrip directional couplers valid for tight and loosely-coupled sections and are implemented in single inductive or capacitive compensated versions.

The above and other features and advantages of the present invention will be better understood from the following detailed description taken in conjunction with the accompanying drawings.

BRIEF DESCRIPTION OF THE DRAWINGS

In FIG. 1, there is shown a layout of a microstrip directional coupler with single capacitive compensation for ideal isolation, in accordance with the preferred embodiment of the invention.

FIG. 2 is a schematic for the even mode equivalent circuit for the microstrip directional coupler of FIG. 1.

FIG. 3 is a schematic for the odd mode equivalent circuit for the microstrip directional coupler of FIG. 1.

FIG. 4 is a schematic representation of the equivalence between the ideal and odd mode representations of the directional coupler with capacitive compensation for ideal match.

FIG. 5 is a layout of a microstrip directional coupler with single inductive compensation for ideal match.

FIG. 6 is a schematic for the odd mode equivalent circuit for the microstrip directional coupler with single inductive compensation.

FIG. 7 is a layout of a microstrip directional coupler with single, centrally-located capacitive compensation.

FIG. 8 is a schematic for the odd mode equivalent circuit for the symmetrical single capacitive compensation microstrip directional coupler.

DETAILED DESCRIPTION OF THE PREFERRED EMBODIMENTS

The single capacitively-compensated microstrip directional coupler 10 shown in FIG. 1 includes four ports 1, 2, 3, and 4 and two symmetrical inner conductors 12 and 14 separated by a gap 16 on a dielectric substrate with relative dielectric constant, $\epsilon_r$. At the far edge of the coupled section, between ports 3 and 4, there is one lumped capacitor 18, implemented on microstrip as shown in FIG. 1.

The method of analysis makes use of the physical symmetry of this directional coupler. By applying symmetric (even mode) and antisymmetric (odd mode) excitation to two colinear ports of the directional coupler, the four-port problem is reduced to that of solving two two-port problems. For example, for the capacitively-compensated case in FIG. 1, the pair of two-ports to be analyzed are shown schematically in FIGS. 2 and 3. The even mode is characterized by a transmission line 20 of electrical length $\theta_e$ and characteristic impedance $Z_{oe}$. Note that the compensating capacitance does not affect the even mode representation.

FIG. 3 shows the coupled odd mode representation which is characterized by a transmission line 24 of electrical length $\theta_o$, with odd mode characteristic impedance, $Z_{oo}$. The overall characteristic impedance is $Z_o$ and is the square root of $Z_{oo}*Z_{oe}$. Capacitor 28 has capacitance 2C.

The standard practice is to describe the two circuits represented in FIGS. 2 and 3 using the ABCD matrix approach, which leads directly to the development of the overall scattering parameters of the directional coupler. Scattering parameters $S_{11}$, $S_{12}$, $S_{13}$. and $S_{14}$; parameters A, B, C, and D; transmission coefficients $T_e$, $T_o$, and T for even mode, odd mode and overall transmission, respectively; reflection coefficients $\Gamma_e$, $\Gamma_o$, and $\Gamma$ for even mode, odd mode and overall reflection, respectively; characteristic impedance $Z_o$; and, characteristic admittance $Y_o$ are related as follows:

$$\Gamma = \frac{A - D + BY_o - CZ_o}{A + D + BY_o + CZ_o} \quad (1)$$

$$T = \frac{2}{A + D + BY_o + CZ_o} \quad (2)$$

$$S_{11} = \frac{\Gamma_e + \Gamma_o}{2} \quad (3)$$

$$S_{12} = \frac{\Gamma_e - \Gamma_o}{2} \quad (4)$$

$$S_{13} = \frac{T_e - T_o}{2} \quad (5)$$

$$S_{14} = \frac{T_e + T_o}{2} \quad (6)$$

Directivity is defined as the difference between isolation and coupling expressed in deciBels (dB). Both isolation I and coupling P are deduced from the scattering matrix of the directional coupler, i.e.:

$$I = 20 \log_{10} \left| \frac{1}{S_{13}} \right| \quad (7)$$

$$P = 20 \log_{10} \left| \frac{1}{S_{21}} \right| \quad (8)$$

For matched directional couplers and maximum isolation or directivity, the following results are necessary:

$$\Gamma_e = -\Gamma_o;\ T_e = T_o;\ A = D = 0 \quad (9)$$

The ABCD matrix for the even mode of the single capacitive compensation of FIG. 2 is as follows:

$$\begin{bmatrix} A & B \\ C & D \end{bmatrix}_e = \begin{bmatrix} \cos\theta_e & jZ_{oe}\sin\theta_e \\ jY_{oe}\sin\theta_e & \cos\theta_e \end{bmatrix}_e \quad (10)$$

For the odd mode, as in FIG. 3:

$$\begin{bmatrix} A & B \\ C & D \end{bmatrix}_o = \begin{bmatrix} \cos\theta_o - 2\omega CZ_{ooa}\sin\theta_o & jZ_{ooa}\sin\theta_o \\ j(Y_{ooa}\sin\theta_o + 2\omega C\cos\theta_o) & \cos\theta_o \end{bmatrix}_o \quad (11)$$

where $\omega$ is the frequency of the input signal and $Y_{oe}$ and $Y_{ooa}$ are the even mode and actual characteristic admittances, respectively.

It is not possible to satisfy both of the latter two equations in the same circuit architecture, since scrutiny of equation 11 reveals:

$$A_o \neq D_o \quad (12)$$

It is possible, however, to provide an ideal match or directivity by satisfying either:

$$\Gamma_e = -\Gamma_o \text{ or } T_e = T_o \quad (13)$$

For an ideally-matched microstrip directional coupler, it will be necessary to deal with the reflection coefficients between the actual realization and the ideal odd-mode representation. FIG. 4 illustrates the correspondence, in which $Z_{ooa}$ and $Z_{ooi}$ are the actual odd-mode and the ideal odd-mode characteristic impedances, respectively, and $\theta_o$ and $\theta_e$ are the actual odd-mode and the even-mode electrical lengths of the coupled sections 30 and 36, respectively. Capacitor 34 of capacitance 2C is connected as shown in FIG. 4 in the odd mode equivalent circuit representation. The ideal odd-mode electrical length is made equal to the even-mode electrical length. Furthermore, the actual characteristic impedance of the odd mode $Z_{ooa}$ is different from the ideal $Z_{ooi}$.

The ABCD circuit representation is used to find the actual odd-mode reflection or transmission coefficients by equating them to the ideal condition. Use of equation (11) in conjunction with equation (1) determines the odd-mode reflection coefficient for the actual representation:

$$\Gamma_{oa} = \frac{-2\omega CZ_{ooa}\sin\theta_o + j(Z_{ooa}Y_o - Y_{ooa}Z_o)\sin\theta_o - j2\omega CZ_o\cos\theta_o}{2\cos\theta_o - 2\omega CZ_{ooa}\sin\theta_o + j(Z_{ooa}Y_o - Y_{ooa}Z_o)\sin\theta_o + j2\omega CZ_o\cos\theta_o} \quad (14)$$

The matrix description for the ideal representation is given by:

$$\begin{bmatrix} A & B \\ C & D \end{bmatrix}_o = \begin{bmatrix} \cos\theta_e & jZ_{ooi}\sin\theta_e \\ jY_{ooi}\sin\theta_e & \cos\theta_e \end{bmatrix} \quad (15)$$

and the reflection coefficient is given by:

$$\Gamma_{oi} = \frac{j(Z_{ooi}Y_o - Y_{ooi}Z_o)\sin\theta_e}{2\cos\theta_e + j(Z_{ooi}Y_o + Y_{ooi}Z_o)\sin\theta_e} \quad (16)$$

Since:

-continued $$Z_o = \sqrt{Z_{ooi}Z_{oe}} \text{ and } k = \frac{Z_{oe} - Z_{ooi}}{Z_{oe} + Z_{ooi}} \tag{17}$$

and, recognizing that at the center frequency:

$$\theta_e = \frac{\pi}{2} \tag{18}$$

then:

$$\Gamma_{oi} = \frac{Z_{ooi}Y_o - Y_{ooi}Z_o}{Z_{ooi}Y_o + Y_{ooi}Z_o} \tag{19}$$

and the ideal odd-mode reflection coefficient becomes:

$$\Gamma_{oi} = -k \tag{20}$$

Since for matched directional couplers:

$$\Gamma_{oa} = -k \tag{21}$$

equations (20), (21), and (14), after equating, separating the result into real and imaginary components, and solving for the compensating capacitance and the new odd-mode characteristic impedance yield:

$$Z_{ooa} = Z_{ooi}\sqrt{1 + \frac{2k}{1+k}\cot^2\theta_o} \tag{22}$$

$$2\omega C = \left(\frac{2k}{1+k}\right)\left(\frac{\cot\theta_o}{Z_{ooa}}\right) \tag{23}$$

Equation (22) demands that:

$$Z_{ooa} \geqq Z_{ooi} \tag{24}$$

which can be achieved by making the inner conductor narrower and increasing the separation to keep the even-mode characteristic impedance constant.

A single inductively-compensated microstrip directional coupler is shown in FIG. 5. The single inductively-compensated microstrip directional coupler 40 shown in FIG. 5 includes four ports 1, 2, 3, and 4 and two symmetrical inner conductors 42 and 44 separated by a gap 46 in a dielectric substrate with relative dielectric constant, $\epsilon_r$. At the far edge of the coupled section, between ports 3 and 4, there is one lumped capacitor 48, implemented on microstrip as shown.

Following the same method of analysis as described for the single capacitively-coupled case, the four-port configuration is reduced to a two-port configuration with odd mode representation as shown in FIG. 6. The coupled region is characterized by a transmission line 50 of electrical length $\theta_o$, with actual odd mode characteristic impedance $Z_{ooa}$. Inductor 54 has inductance L/2 and is positioned as indicated in the FIG. 6 odd mode representation. The ABCD matrix which corresponds to the circuit is given by:

$$\begin{bmatrix} A & B \\ C & D \end{bmatrix}_o = \begin{bmatrix} \cos\theta_o + \frac{2Z_{ooa}}{\omega L}\sin\theta_o & jZ_{ooa}\sin\theta_o \\ j\left(Y_{ooa}\sin\theta_o - \frac{2}{\omega L}\cos\theta_o\right) & \cos\theta_o \end{bmatrix} \tag{25}$$

Combining equations (25), (1), and (20), and separating real and imaginary parts yields:

$$Z_{ooa} = Z_{ooi}\sqrt{1 - \left(\frac{2k}{1-k}\right)\cot^2\theta_o} \tag{26}$$

$$\omega L = \left(\frac{1-k}{k}\right)Z_{ooa}\tan\theta_o \tag{27}$$

Note that equation (26) demands that:

$$Z_{ooa} \leqq Z_{ooi} \tag{28}$$

The inner conductor can be made wider and the separation decreased to keep the even-mode characteristic impedance constant.

For the case of ideal isolation or directivity of a microstrip directional coupler, the transmission coefficients are equated between the actual realization and the ideal odd-mode representations. The first structure to be considered is that of a single capacitive compensation between Ports 3 and 4 of FIG. 1. Use of equation 11 in conjunction with equation (2) determines the odd-mode transmission coefficient for the actual representation. The ideal odd-mode transmission coefficient at the center frequency of operation is given by:

$$T_{oi} = -j\sqrt{1-k^2} \tag{29}$$

Equating real and imaginary components, and solving for the compensating capacitance and a new odd mode characteristic impedance yields:

$$Z_{ooa} = \frac{Z_o}{\sqrt{1-k^2}\sin\theta_o}\left[1 - k\sqrt{1 - \frac{(1-k^2)}{k^2}\cos^2\theta_o}\right] \tag{30}$$

$$2\omega C = \frac{2\cot\theta_o}{Z_{ooa}} \tag{31}$$

The single central capacitively-compensated microstrip directional coupler 60 shown in FIG. 7 consists of four ports 1, 2, 3, and 4 and two symmetrical inner conductors 62 and 64 separated by a gap 66 in a dielectric substrate with relative dielectric constant, $\epsilon_r$. At the center of the coupled section there is one lumped capacitor 68, implemented as shown.

The odd-mode equivalent circuit for the directional coupler in FIG. 7 can be represented as in FIG. 8. The equivalent circuit coupled region is characterized by two transmission lines 70 and 74, each of electrical length $\theta_o/2$ and characteristic impedance $Z_{ooa}$. Capacitor 78 has capcitance 2C. The corresponding ABCD matrix representation is:

$$\begin{bmatrix} A & B \\ C & D \end{bmatrix} = \begin{bmatrix} \cos^2\frac{\theta_o}{2} & \sin^2\frac{\theta_o}{2} & 2\omega C Z_{ooa}\cos\frac{\theta_o}{2} & \sin\frac{\theta_o}{2} & jZ_{ooa}\sin\frac{\theta_o}{2}\left(2\cos\frac{\theta_o}{2}\ Z_{ooa}2\omega C\sin\frac{\theta_o}{2}\right) \\ j\left(2Y_{ooa}\sin\frac{\theta_o}{2} + 2\omega C\cos\frac{\theta_o}{2}\right)\cos\frac{\theta_o}{2} & \cos^2\frac{\theta_o}{2} & \sin^2\frac{\theta_o}{2} & 2\omega C Z_{ooa}\cos\frac{\theta_o}{2} & \sin\frac{\theta_o}{2} \end{bmatrix} \quad (32)$$

Solving yields:

$$Z_{ooa} = Z_{ooi}\cot\left(\frac{\theta_o}{2}\right) \quad (33)$$

$$2\omega C = \frac{1 - \tan^2\left(\frac{\theta_o}{2}\right)}{Z_{ooi}} \quad (34)$$

At the center frequency, the matrix representation for the symmetrical single capacitive representation reduce to:

$$\begin{bmatrix} A & B \\ C & D \end{bmatrix} = \begin{bmatrix} 0 & jZ_{ooi} \\ jY_{ooi} & 0 \end{bmatrix} \quad (35)$$

This leads to an ideal directional coupler with the following S-parameters:

$$[S] = \begin{bmatrix} 0 & k & -j\sqrt{1-k^2} & 0 \\ k & 0 & 0 & -j\sqrt{1-k^2} \\ -j\sqrt{1-k^2} & 0 & 0 & k \\ 0 & -j\sqrt{1-k^2} & k & 0 \end{bmatrix} \quad (36)$$

The use of the developed formulas are demonstrated via design examples of an edge-coupled microstrip directional coupler. The preferred embodiments use a substrate of gallium arsenide (GaAs) with a metal thickness of approximately three micrometers (3 μm), height of approximately one hundred micrometers (100 μm) and $\epsilon_r$ of approximately 12.9.

Table 1 shows the pertinent data regarding the microstrip directional coupler requirements and coupled line realization for both uncompensated, capacitively compensated and inductively compensated structures for the ideally matched case. Table 2 provides similar information for the asymmetric (ideal isolation) and symmetric (ideal coupler) capacitive compensation.

TABLE 1

MICROSTRIP DIRECTIONAL COUPLER IDEALLY MATCHED CASE

| Parameters | Uncompensated | Asymmetric Capacitor | Asymmetric Inductor |
|---|---|---|---|
| Center frequency | 35 GHz | 35 GHz | 35 GHz |
| Coupling | −7.25 dB | −7.0 dB | −7.0 dB |
| $Z_o$ | 50 ohms | 50 ohms | 50 ohms |
| $Z_{oe}$ | 80.85 ohms | 80.85 ohms | 80.85 ohms |
| $Z_{oo}$ | 30.92 ohms | 31.59 ohms | 29.09 ohms |
| $\epsilon_{effe}$ | 8.83 | 8.83 | 8.83 |
| $\epsilon_{effo}$ | 6.14 | 6.17 | 6.04 |
| Coupled line: | | | |
| width | 45.81 μm | 45.32 μm | 47.26 μm |
| separation | 18.70 μm | 19.93 μm | 15.28 μm |
| parallel length | 785.82 μm | 721 μm | 721 μm |

TABLE 1-continued

MICROSTRIP DIRECTIONAL COUPLER IDEALLY MATCHED CASE

| Parameters | Uncompensated | Asymmetric Capacitor | Asymmetric Inductor |
|---|---|---|---|
| Directivity | 13.25 dB | finite | finite |
| Match | finite | 0 | 0 |
| Capacitive compensation | | 0.012 pF | |
| Inductive compensation | | | 0.614 nH |

TABLE 2

MICROSTRIP DIRECTIONAL COUPLER IDEAL SOLUTION AND IDEAL COUPLER CAPACITIVE COMPENSATION CASES

| Parameters | Uncompensated | Asymmetric Capacitor | Symmetric Capacitor |
|---|---|---|---|
| Center frequency | 35 GHz | 35 GHz | 35 GHz |
| Coupling | −7.25 dB | −7.0 dB | −7.0 dB |
| $Z_o$ | 50 ohms | 50 ohms | 50 ohms |
| $Z_{oe}$ | 80.85 ohms | 80.85 ohms | 80.85 ohms |
| $Z_{oo}$ | 30.92 ohms | 35.72 ohms | 40.26 ohms |
| $\epsilon_{effe}$ | 8.83 | 8.83 | 8.81 |
| $\epsilon_{effo}$ | 6.14 | 6.17 | 6.43 |
| Coupled line: | | | |
| width | 45.81 μm | 42.07 μm | 39.47 μm |
| separation | 18.70 μm | 28.25 μm | 35.72 μm |
| parallel length | 785.82 μm | 721 μm | 721 μm |
| Directivity | 13.25 dB | infinite | infinite |
| Match | finite | finite | 0 |
| Capacitive compensation | | 0.034 pF | 0.027 pF |

Scrutiny of results indicate ideal directivity, on frequency operation, and no change in coupling value for the symmetric case. Also, the ideal match case has an improved isolation and the ideal isolation case has an improved match as compared to the non-compensated case.

Thus, a directional coupler with single capacitive or inductive compensation has been described which overcomes specific problems and accomplishes certain advantages relative to prior art methods and mechanisms. The improvements over known technology are significant. Traditional methods of improving the directivity of such couplers, such as adding an additional layer of dielectric over the conductors for symmetry, serrating the gap between the conductors, adding lumped capacitors at each end of the coupler, or selecting two or more different materials of different thicknesses and permittivities for the multi-level substrate are associated with particular disadvantages. Adding a slab of dielectric adds material and introduces adhesive between the metallization and the substrate. Such a structure may require handcrafting, or at least additional fabrication steps. Serrating the gap between the conductors does not produce a satisfactory compensation for all values of the coupling. For lumped capacitance added at each end of the coupler are nearly true for tight coupling, the center frequency predicted is lower than desired. This result necessitates foreshortening the coupled section. Furthermore, for loosely coupled sections, the equations are no longer valid.

The traditional methods lack a design method for determining appropriate compensation without resorting to empirical means. None of the traditional methods has associated with it a closed form solution for the compensating lumped capacitance and odd mode characteristic impedance necessary to realize an ideal microstrip directional coupler.

The directional coupler described here overcomes these previous shortcomings and has associated with it a closed form solution for the compensating lumped capacitance and a new odd mode characteristic impedance necessary to realize an ideal microstrip directional coupler. The results are accurate for either tight or loosely-coupled sections. The method results in embodiments for both antisymmetric and symmetric microstrip directional couplers with single inductive or capacitive compensation.

Thus, there has been provided, in accordance with an embodiment of the invention, a directional coupler with single capacitive or inductive compensation that fully satisfies the aims and advantages set forth above. While the invention has been described in conjunction with a specific embodiment, many alternatives, modifications, and variations will be apparent to those of ordinary skill in the art in light of the foregoing description. Accordingly, the invention is intended to embrace all such alternatives, modifications, and variations as fall within the spirit and broad scope of the appended claims.

I claim:

1. A microwave monolithic integrated circuit microstrip directional coupler with a center operating frequency on the order of 35 GHz comprising:

planar first conductive means with first and second ports;

planar second conductive means with first and second ports, wherein the second conductive means is coplanar with the first conductive means and is symmetric to the first conductive means with respect to a plane of symmetry perpendicular to and equidistant from a linear section of the first conductive means and a linear section of the second conductive means;

a dielectric substrate layer to which the first and second conductive means are immediately adjacent; and a single lumped element compensator positioned at one end of the linear sections of the first and second conductive means with a first end of the single lumped element compensator electrically connected to the first conductive means and a second end of the single lumped element compensator electrically connected to the second conductive means.

2. A microstrip directional coupler as claimed in claim 1 wherein the single lumped element compensator comprises a capacitor.

3. A microstrip directional coupler as claimed in claim 2 wherein the capacitor comprises a variable capacitor.

4. A microwave monolithic integrated circuit microstrip directional coupler with a center operating frequency on the order of 35 GHz comprising:

planar first conductive means with first and second ports;

planar second conductive means with first and second ports, wherein the second conductive means is coplanar with the first conductive means and is symmetric to the first conductive means with respect to a plane of symmetry perpendicular to and equidistant from a linear section of the first conductive means and a linear section of the second conductive means;

a dielectric substrate layer to which the first and the second conductive means are immediately adjacent; and a variable capacitor positioned equidistant from first and second ends of linear sections of the first and second conductive means with the variable capacitor electrically connected between the first and the second conductive means.

5. A microstrip directional coupler as claimed in claim 1 wherein the single lumped element compensator comprises an inductor.

6. A microwave monolithic integrated circuit microstrip directional coupler with center operating frequency on the order of 35 GHz comprising:

first and second parallel coupled transmission lines bilaterally symmetric along an axis parallel to adjacent linear sections of the first and second parallel coupled transmission lines;

dielectric substrate separating the first and second parallel coupled transmission lines; and single lumped element compensation means, the single lumped compensation means positioned at one end of linear sections of the first and second parallel coupled transmission lines with a first end of the single lumped element compensation means electrically connected to the first parallel coupled transmission line and a second end of the single lumped element compensation means electrically connected to the second parallel coupled transmission line.

7. A microstrip directional coupler as claimed in claim 6 wherein the single lumped element compensation means comprises a capacitor.

8. A microstrip directional coupler as claimed in claim 7 wherein the capacitor comprises a variable capacitor.

* * * * *